United States Patent [19]

Hasegawa

[11] Patent Number: 4,957,075

[45] Date of Patent: Sep. 18, 1990

[54] APPARATUS FOR CONTROLLING INLET OF EXHAUST VALVES

[75] Inventor: Shumpei Hasegawa, Saitama, Japan

[73] Assignee: Honda Giken Kogyo Kabushiki Kaisha, Tokyo, Japan

[21] Appl. No.: 403,852

[22] Filed: Sep. 5, 1989

Related U.S. Application Data

[63] Continuation of Ser. No. 145,479, Jan. 19, 1988, abandoned.

[30] Foreign Application Priority Data

Jan. 19, 1987 [JP] Japan ..... 62-8099

[51] Int. Cl.[5] ..... F01L 1/00

[52] U.S. Cl. ..... 123/90.12; 251/30.01; 251/33

[58] Field of Search ..... 123/90.12, 90.13, 90.15, 123/90.16; 251/30.01, 33

[56] References Cited

U.S. PATENT DOCUMENTS 873,822 12/1907 Wolfe ..... 251/30.01
2,543,652 2/1951 Weymouth ..... 251/30.01
3,188,047 6/1965 Criffield ..... 251/33
4,462,566 7/1984 French ..... 251/33
4,615,306 10/1986 Wakeman ..... 123/90.16

*Primary Examiner*—Andrew M. Dolinar
*Assistant Examiner*—M. Macy
*Attorney, Agent, or Firm*—Lyon & Lyon

[57] ABSTRACT

A hydraulic system for controlling the operation of the intake or exhaust valves of an internal combustion engine. For each valve there is a sealed hydraulic chamber with one plunger driven by a rotating cam to a camshaft and another plunger for actuating the valve. A single solenoid valve is connected by a separate passage having a check valve to each of a plurality of hydraulic chambers. The single solenoid valve can be opened during the actuation of any one of the valves to cause rapid closing of the valve by draining the hydraulic oil from the hydraulic chamber without causing premature actuation of another valve or effecting the subsequent operation of other valves after closing of the single solenoid valve.

3 Claims, 4 Drawing Sheets

APPARATUS FOR CONTROLLING INLET OF EXHAUST VALVES

This application is a continuation of application Ser. No. 145,479, filed Jan. 19, 1988 now abandoned.

The present invention relates to an apparatus hydraulically operating and controlling inlet or exhaust valves of a multiple cylinder internal combustion engine and specifically to an improvement in the hydraulic system.

In recent years, a system has been developed in which inlet or exhaust valves of an internal combustion engine are hydraulically actuated to control the time at which the valves are opened or closed. One apparatus of this kind is the subject of a separate Japanese patent application filed on the same day and by the same inventor as the Japanese priority application for the present application. That apparatus for hydraulically actuating inlet or exhaust valves is shown in FIGS. 3–5 and will be described below to establish the context within which the present invention is applicable. The hydraulic system that is the subject of that related patent application includes a control means that is quite effective in controlling the instants at which the valves are closed. Also, that hydraulic system is capable of controlling one or more valves of one cylinder of an engine with a single control unit. However, for a multiple-cylinder engine, it is necessary to use as many solenoid valves in that hydraulic system as there are cylinders when it is desired to control the instants at which the inlet or exhaust valves for each of the cylinders are closed. This is very undesirable in terms of required space and extra cost. Additional valve operating mechanisms of this type with the same disadvantage of requiring a separate hydraulic valve for each intake or exhaust valve are disclosed in U.S. Pat. Nos. 4,153,016; 4,671,221 and 4,674,451.

The object of the present invention is to provide a means for solving the foregoing problems and in particular, to provide a means which is capable of controlling the inlet or exhaust valves for several cylinders with a single solenoid valve.

The above object is achieved in accordance with the teachings of this invention by an apparatus in which sealed hydraulic chambers for the cylinders of an internal combustion engine are connected with their respective low-pressure portions via a common solenoid valve, and in which one-way valves are disposed on the upstream sides of junctions between the hydraulic chambers and the solenoid valve to prevent fluid from flowing in a reverse direction.

The invention will be described in connection with a preferred embodiment and its relationship to the valve operating apparatus of the related patent application by applicant, as shown in the drawings, wherein:

FIG. 1 is a schematic diagram of a system for controlling inlet or exhaust valves of a two-cylinder engine, for example in accordance with the present invention;

FIGS. 2(*a*)–2(*d*) are timing charts for illustrating the operation of main portions of the system shown in FIG. 1;

Figure 3:
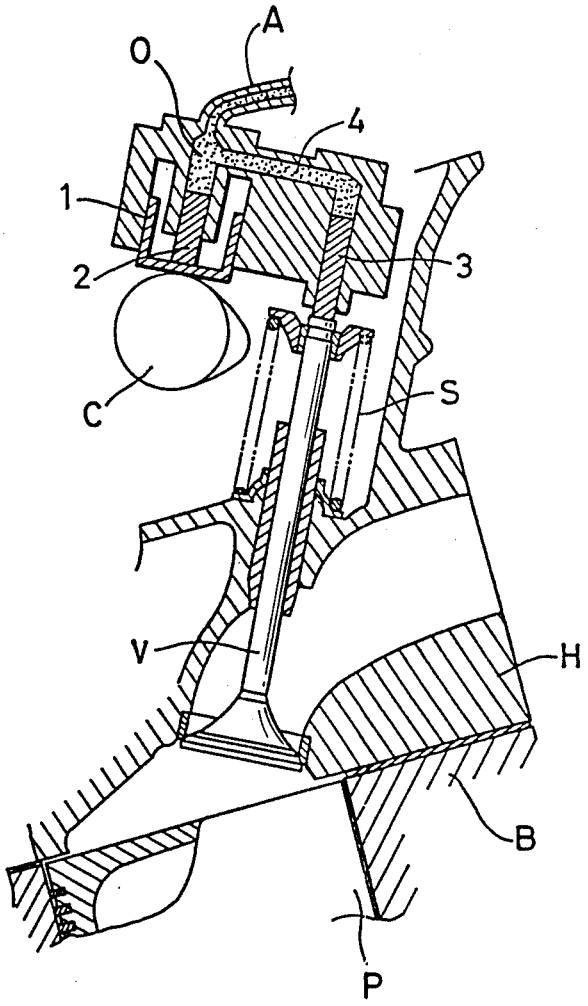
FIG. 3 is a cross-sectional view of the main portions of the apparatus for actuating valves.
Figure 4:
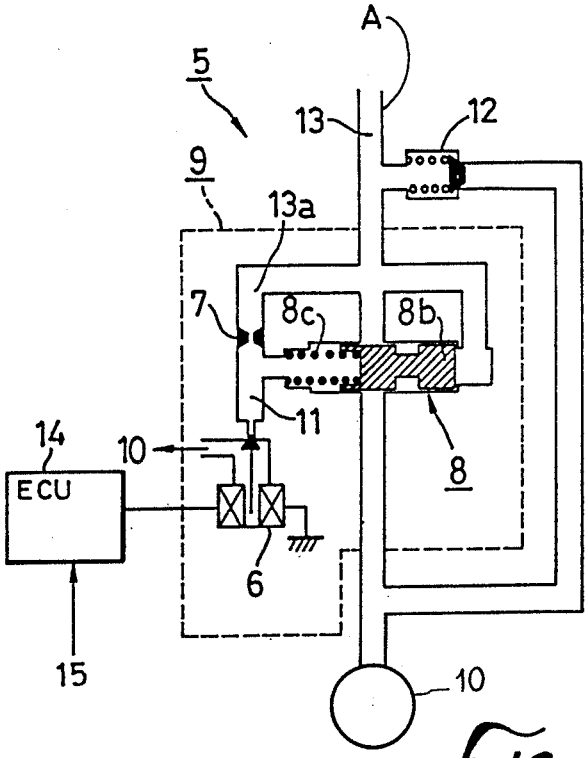
FIG. 4 is a diagram of the control portion of the apparatus shown in FIG. 3.
Figure 5:
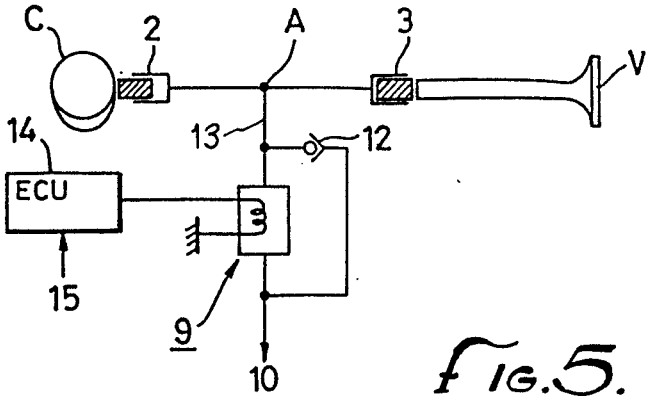
FIG. 5 is a schematic diagram of the apparatus shown in FIGS. 3 and 4.

Referring now to FIGS. 3, 4 and 5, the apparatus of the related application will be described first for providing a basis to understand the application of the present invention to a hydraulically operated valve system. FIG. 3 shows a portion of a cylinder block B, a portion of a piston P, a portion of a cylinder head H, and inlet or exhaust valve V, a spring S, and a cam C for opening and closing the valve. A lifter 1 is in contact with the cam C and mechanically drives a hydraulic plunger 2 that engages the lifter. A hydraulic plunger 3 is hydraulically driven by the movement of plunger 2 to directly actuate the valve V by reason of the plunger 3 being aligned with and engaging the end of the stem of the valve V. A hydraulic chamber or passage 4 is filled with working oil 0 and connects the two cylinder portions in which the plungers are slidably mounted. This chamber 4 is also connected to a portion A of a passage 13 of a control system 5 shown in FIG. 4.

Referring next to FIG. 4, a pilot solenoid valve 6 has a solenoid that is energized in response to the output signal of an engine control unit (ECU) 14 which operates in accordance with a given program input 15 for controlling the running of the engine. A passage 13*a* branches off the passage 13 and has an orifice 7. The portion of the passage 13*a* which is on the back pressure side is indicated by numeral 11. A main valve, such as spool valve 8, acts to control the back pressure. The spool valve 8, as shown, has a spool 8*b* that slides within the valve barrel. The valve 8 also includes a compressed coil spring 8*c*. The pilot solenoid valve 6, the passage 11 on the back pressure side, and the spool valve 8 constitute a solenoid valve 9, as shown surrounded by the broken line. The high-pressure passage 13 is in communication with the portion A shown in FIG. 3 and connected with a hydraulic low-pressure source 10 via the spool valve 8. A check valve 12, or one-way valve, is disposed between the high-pressure passage 13 and the pressure source 10 in a parallel relation to the spool valve 8.

The operation of the structure described will now be explained. Referring to FIG. 3, when the cam C is rotated, the lifter 1 drives the hydraulic plunger 2 in response to whether it contacts the base circle portion or the lobe on the cam. Then, the hydraulic plunger 3 engaging the valve is actuated by the static pressure of the working fluid 0 inside the hydraulic chamber 4 to thereby actuate the valve V according to the vertical movement of the lobe on the contour of the cam C.

In the control system 5 communicating with the portion A of the passage 13 shown in FIG. 4, the high hydraulic pressure supplied from the plunger 2 upon movement of the lifter 1 by the cam lobe is applied to a low-pressure oil source 10 via the solenoid valve 9 that is actuated by the engine control unit 14 in accordance with a given program for controlling the engine operation.

When the lobe of the cam C is elevating the plunger 2 to start to pressurize the working oil 0 and open the valve V, if the pilot solenoid valve 6 opens, then the pressure inside the passage 11 decreases. The pressurized oil 0 rapidly opens the spool valve 8 against the action of the spring 8C by applying the oil pressure to the right-hand end (as viewed in FIG. 4) of the spool 8. Since the size and the effective area of the opening of the spool valve 8 is large, the pressurized oil 0 is allowed to escape rapidly to the low-pressure oil source 10. As a result, the pressure drops in passage 13, portion A and passage 4 and the valve V is closed by the spring S.

The check valve 12 shown in FIG. 4 is provided to replenish the hydraulic chamber 4 shown in FIG. 3 with the working oil 0 from the hydraulic low-pressure source 10 after the spool valve 8 closes again.

Where the engine runs on gasoline, for example, the inlet valves can be closed at optimum early instants over a wide range of engine speeds. This enhances the output power and the fuel economy, which is a well-known principle as disclosed in SAE paper No. 820,408.

Figure 1:
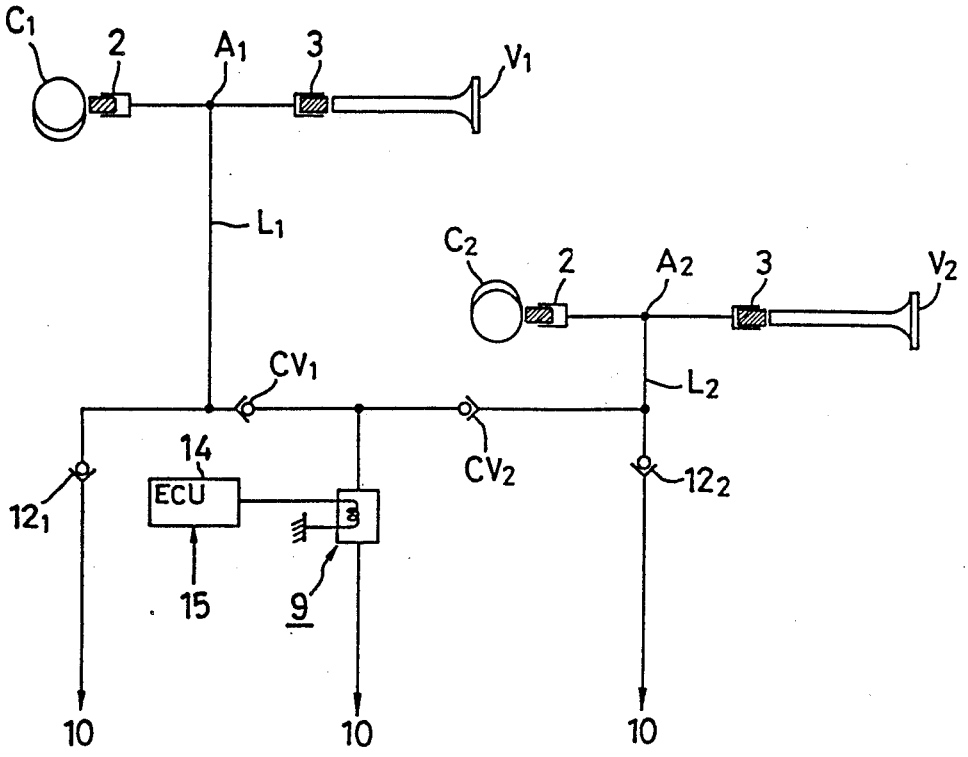

Turning now to the present invention, as it is applicable to a system such as shown in FIGS. 3, 4 and 5. FIG. 1 schematically shows a means for controlling one inlet or exhaust valve of a two cylinder engine, although it will be understood by those skilled in the art that the invention is also applicable to engines with more than two cylinders. This FIG. 1 is drawn in a manner to correspond to FIG. 5 diagrammatically showing the system of FIGS. 3 and 4. It is to be noted that like components are indicated by like reference numerals throughout FIGS. 1, 3–5.

Referring further to FIG. 1, the two-cylinder engine has a first cylinder equipped with an inlet or exhaust valve $V_1$ and a cam $C_1$. The engine further has a second cylinder equipped with an inlet or exhaust valve $V_2$ and a cam $C_2$. The first and second cylinders are further provided with lines $L_1$, $L_2$ and check valves $12_1$ and $12_2$, respectively, which correspond to the line 13 and the check valve 12, respectively, shown in FIG. 5.

This example is characterized in that the hydraulic chambers of the cylinders for actuating the valves are connected with hydraulic low-pressure sources 10 via a common solenoid valve 9 through the lines $L_1$ and $L_2$, respectively, and that check valves $CV_1$ and $CV_2$ are disposed in the lines $L_1$ and $L_2$, respectively, on the upstream side of the solenoid valve 9 and in parallel with the check valves $12_1$ and $12_2$ to prevent fluid from flowing in a reverse direction from the solenoid valve 9 into the lines $L_1$ and $L_2$.

Figure 2:
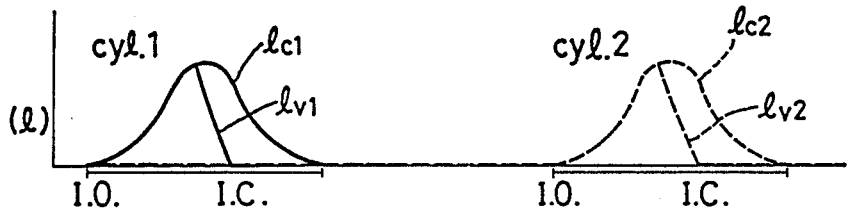
Figure 2:
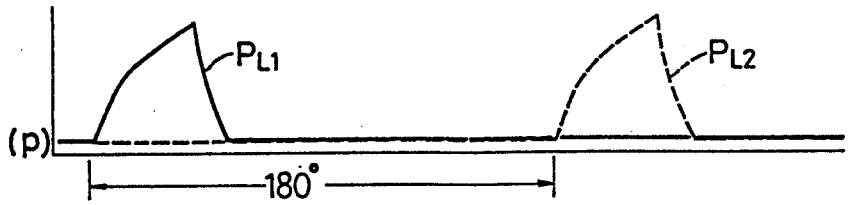
Figure 2:
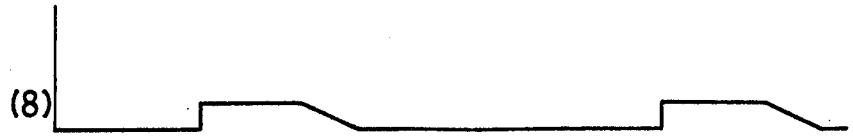
Figure 2:
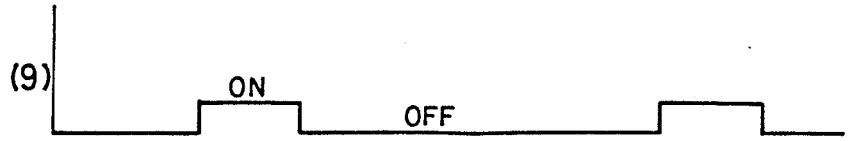

The operation of the structure constructed as described above will be described next by referring also to FIG. 2. In FIGS. 2(*a*)–2(*d*), the valves $V_1$ and $V_2$, shown in FIG. 1 act as inlet valves. FIG. 2(*a*) shows the ratios of lifts $l\ c_1/l\ c_2$ and $l\ v_1/l\ v_2$ traveled by the cams $C_1$, $C_2$ and the valves $V_1$, $V_2$ of the cylinders 1 and 2, respectively. FIG. 2(*b*) shows the pressures $P_{L1}$ and $P_{L2}$ inside the lines $L_1$ and $L_2$, respectively. FIG. 2(*c*) shows the degree of opening of the spool valve 8 (FIG. 4) of the solenoid valve 9. FIG. 2(*d*) shows the level of a control signal produced by an engine control unit 14 for actuating the pilot solenoid valve 6 (FIG. 4) of the solenoid valve 9. In FIG. 2(*a*), each inlet valve starts to open at point I.O. and closes at point I.C.

When the cam $C_1$ on the first cylinder drives a hydraulic plunger 2 on the side of the cam, the working oil inside the line $L_1$ is pressurized, but the check valve $CV_2$ prevents the line $L_2$ connected with the second cylinder from being subjected to this pressure.

The engine control unit (ECU) 14 produces a control signal in accordance with a certain program 15 that controls the running of the engine to open the pilot solenoid valve 6 of the solenoid valve 9, as previously described. Then, the pressure $PL_1$ inside the line $L_1$ decreases rapidly to open the spool valve 8. The inlet valve $V_1$ is closed quickly by a spring S, as previously described, and the valve closing movement is illustrated by the line $lv_1$ shown in FIG. 2(*a*). Subsequently, the engine control unit 14 produces another control signal to close the solenoid valve 9, whereupon, in this condition, the pressures inside the lines $L_1$ and $L_2$ are low.

When the cam $C_2$ on the second cylinder drives the hydraulic plunger 2, the pressure $PL_2$ inside the line $L_2$ increases, but the pressure $PL_1$ inside the line $L_1$ connected with the first cylinder is maintained low because of the action of the check valve $CV_1$.

The second cylinder operates in the same manner as the first cylinder. These two cylinders are operated at good timing under the control of the single solenoid valve 9. Since only one solenoid valve is employed, the space and the cost can be minimized. Also, the improved timing prevents the valves from having different operating characteristics. Hence, the engine is improved.

In the above example, the inlet valves of a two-cylinder engine were described. It is to be noted, however, that the inventive principle can be applied to any number of inlet or exhaust valves of a multiple-cylinder engine as long as the selected valves for the cylinders do not open or close simultaneously or during too close a time frame as to cause the increased levels of oil pressures PL for the controlled valves to overlap.

As described above, in accordance with this invention, a single solenoid valve is used with a hydraulic control apparatus that controls the operation of inlet or exhaust valves. The single solenoid valve opens or closes the inlet or exhaust valves of a multiple-cylinder engine one after another. This reduces the space and the cost. Further, the valves for all the cylinders can be actuated uniformly.

What is claimed:

1. In an apparatus for hydraulically controlling inlet or exhaust valves of a multiple-cylinder engine having sealed hydraulic chambers and solenoid valve means that open and close to connect and disconnect the hydraulic chambers with a hydraulic low-pressure source, each hydraulic chamber having a first plunger driven by a cam and a second plunger for actuating an inlet or exhaust valve, the improvement comprising said solenoid valve means comprising a single solenoid valve having a plurality of passages connected separately to a like plurality of hydraulic chambers, a one-way valve disposed in each passage between the associated hydraulic chamber and said single solenoid valve to permit fluid flow in a direction from said associated hydraulic chamber to said single solenoid valve but to prevent flow from any of the other hydraulic chambers of said plurality of hydraulic chambers;

said solenoid valve means comprising control means including a hydraulically-operated main valve operative in said hydraulic chambers to control the fluid pressure therein and said solenoid valve being a pilot valve operatively associated with said main valve to actuate said main valve to effect fluid flow from said hydraulic chambers in response to actuation of said solenoid valve; and each said hydraulic chamber being connected to said low pressure oil source through another one-way valve for adding oil to the hydraulic chamber as needed when the hydraulic chamber is at a pressure lower than said low pressure oil source.

2. The apparatus of claim 1 in which said main valve is operated to the closed position by a throttled portion of the hydraulic fluid admitted to the inlet thereof, and said pilot valve being operative, when actuated, to release said main valve operating fluid to effect opening of said main valve.

3. A valve timing control system for an engine having a plurality of cylinders and inlet and exhaust valves operative in said cylinders, comprising rotatable cams for operating the respective of said valves, each said cam having a lobe and a base circle portion to effect opening and closing, respectively, of said valves and the lobes of said cams being mutually angularly displaced to effect opening and closing of said valves in sequence;

a sealed hydraulic chamber operatively associated with each of said valves including a first plunger driven by the associated cam, a second plunger for actuating the associated valve and a fluid body intermediate said plungers for moving said second plunger in response to the cam-driven movement of said first plunger;

a low pressure oil source;

means forming fluid passages extending between the respective hydraulic chambers and said low pressure oil source;

solenoid valve means connected in common with all of said fluid passages, said solenoid valve means including a normally closed solenoid valve;

a first one-way valve disposed in each of said fluid passages between the associated hydraulic chamber and said solenoid valve means effective to permit fluid flow only in the direction from said hydraulic chamber to said solenoid valve means;

a second one-way valve disposed in said fluid passages connecting the respective of said hydraulic chambers and said oil source to effect the sequential addition of oil to said hydraulic chambers when the pressure therein is below that in said oil source; and means for controlling the energization of said solenoid valve to occur substantially coincident with the actuation of the first plunger of a selected valve to transfer the fluid body from the hydraulic chamber thereof to said low pressure source to selectively terminate operation of the respective inlet or exhaust valves.

* * * * *